US005324554A

United States Patent [19]

Tamura et al.

[11] Patent Number: 5,324,554

[45] Date of Patent: Jun. 28, 1994

[54] CORE FOR PHOTOGRAPHIC LIGHT-SENSITIVE MATERIAL

[75] Inventors: Junichi Tamura, Yokohama; Yuichi Machida, Odawara; Chikara Amano, Matuda, all of Japan

[73] Assignee: Konica Corporation, Tokyo, Japan

[21] Appl. No.: 928,035

[22] Filed: Aug. 11, 1992

[30] Foreign Application Priority Data

Aug. 27, 1991 [JP] Japan ..... 3-215422

[51] Int. Cl.[5] ..... B65H 75/10; G03C 3/00

[52] U.S. Cl. ..... 428/2; 428/218; 428/220; 428/535; 430/49; 430/96

[58] Field of Search ..... 428/2, 220, 218, 535; 430/96, 49

[56] References Cited

FOREIGN PATENT DOCUMENTS 0421400 4/1991 European Pat. Off. .

7345916 12/1973 Fed. Rep. of Germany .

549523 5/1974 Switzerland .

OTHER PUBLICATIONS

Patent Abstracts of Japan, vol. 14, No. 340 (P-1080) Jul. 23, 1990, JP-A-21 16 882, Fuji Photo Film Company, May 1, 1990.

*Primary Examiner*—P. C. Sluby

*Attorney, Agent, or Firm*—Finnegan, Henderson, Farabow, Garrett & Dunner

[57] ABSTRACT

A core for photographic light-sensitive material use made of wooden source material which can be recycled or decomposed in natural environment is disclosed. The core center is made of paper covered with a buffer layer made of 100% wooden pulp having a density of not more than 0.1 g/cm$^3$. The buffer layer is covered with a reinforcing sheet made of paper with a tensile strength of 0.3 kg/15 mm width or more.

5 Claims, 3 Drawing Sheets

CORE FOR PHOTOGRAPHIC LIGHT-SENSITIVE MATERIAL

FIELD OF THE INVENTION

The present invention relates to a core for photographic light-sensitive material use, and more particularly to a core whose winding condition, processing accuracy and disposability have been improved and to a manufacturing method therefor.

BACKGROUND OF THE INVENTION

In production of photographic light-sensitive materials, it is normal that a photographic light-sensitive material is slit to a predetermined width, wound around a core for a specified length to form a roll which is covered with a light-shielding material.

It is ideal that this photographic light-sensitive material in a roll shape is wound evenly and tightly from the start of winding up to the end of winding as far as possible from the viewpoint of storage conditions, distribution conditions and easy handling.

However, this photographic light-sensitive material in a roll shape has a step whose height corresponds to the thickness of the photographic light-sensitive material near the core. The step causes high concentrated pressure when trying to wind up tightly, resulting in a protruded deformation (press mark) and sensitivity abnormality on the photographic light-sensitive material near the core.

Due to the abnormality mentioned above, it has been impossible to use about 20% of photographic light-sensitive materials which are expensive.

Therefore, the proposals described below have been made.

For example, Japanese Patent Publication Open to Public Inspection Nos. 165861/1984 and 164275/1987 (hereinafter referred to as Japanese Patent O.P.I. Publication), Japanese Patent Examined Publication No. 24116/1990, Japanese Patent O.P.I. Publication Nos. 142941/1989 and 116882/1990 disclose technology wherein a conventional core has been improved in a way that a buffer layer is provided for preventing an influence of a step on the end of a photographic light-sensitive material. Elastic adhesives, resin foaming substances and paper or synthetic paper having low density are used as a material of the buffer layer. Further, for example, technology, wherein the same effect as in the above is achieved by providing a cutout on the external surface of the core without providing a buffer layer, is disclosed in Japanese Patent O.P.I. Publication Nos. 14072/1988, 8689/1991 and 8690/1991.

It has been effective, as a core around which a photographic light-sensitive material is wound, to provide a buffer layer for preventing deformation (press mark) and abnormality of sensitivity caused by pressure caused on a photographic light-sensitive material near the core. However, resin materials, various rubber or elastic adhesives glued on the core have deteriorated the core, after the core becomes waste, on the points of disposability and reusability.

Namely, substances used as these buffer materials do not decompose spontaneously when disposed as waste, for example, and even when they are subjected to incineration, they produce a toxic gas which damages an incinerator together with high temperature therein.

When recycled, the abovementioned buffer layer needs to be removed, which is time-consuming. Actually, however, some of the buffer layers are glued firmly and can not be removed.

With regard to disposal of waste, each country has its own law, and in Europe, in particular, it is required that a single kind of material is used. Therefore these cores do not comply with the law.

Even when a nonwoven fabric is used as a material having a buffer effect, the unwoven fabric is usually made of various synthetic fibers such as nylon, rayon and polyester or the like for the purpose of an improvement of its strength, or these synthetic fibers are generally mixed with pulp at a rate of about 20%–60%.

These synthetic fibers are problematic from the viewpoints of disposability and adaptability for recycling. When they are of a single material without reinforcement, which is ideal for improvement in disposability and adaptability for recycling, the strength thereof becomes too low to be processed as a core.

For the processing of a core, for example, a material of a core is required to have tensile strength of 0.3 kg/15 mm or more. A dry unwoven fabric made of a single material of pulp has tensile strength of 0.3–0.6 kg/15 mm when dry, while 15 times foamed polystyrene known in the conventional example has that of about 6 kg/15 mm. When adhesives are coated on the unwoven fabric for pasting it on the core, however, tensile strength of the unwoven fabric falls sharply to 0.1–0.3 kg/15 mm due to its wet state, preventing it from being wound round the core.

In the method of providing a cutout on the external surface of a core, on the other hand, an end of a light-sensitive material needs to be positioned accurately to engage with the cutout in a dark room. Therefore, complicated equipment and reduction of efficiency caused by increased working hours can not be avoided.

On the other hand, a slitter wherein the core is used has recently been highly automated and complicated and productivity has been steeply enhanced. However, a core to be used therein has actually been required to have higher dimensional accuracy.

Heretofore, however, attention has been paid only to an influence of moisture and oxidation-reduction substances contained in the core on a photographic light-sensitive material. Therefore, the core, after being cut to the predetermined dimensions, has been stored in a cardboard box packaging, and immediately before it is used, it has been subjected to a drying process under predetermined conditions of temperature and time, for example, 50° C. and 24 hours to be adjusted to 8% or less in terms of moisture content.

In the above occasion, the core has been cut to dimensions wherein a constant percentage of shrinkage of the core is considered so that the core may have predetermined dimensions after drying, because the width of the core shrinks after the drying process. However, it has been impossible to satisfy the required dimensional accuracy, due to dimensional dispersion in the process for cutting a core and dispersion in the progress of drying caused by the difference of taken-in moisture such as, for example, the difference between positions in cardboard box packaging such as upper, middle or lower position or the difference between seasons.

For further improvement of dimensional accuracy, there have been taken various methods such as control of moisture content in a core material, change of cutting dimensions for each season and calculation of design value for each time based on a shrinkage factor by moisture content. However, all of them have required extremely complicated moisture content control and calculation, inventory control and work. Therefore, they proved to be difficult to carry out and failed to be a basic solution, resulting in equipment problems and complaints from customers.

SUMMARY OF THE INVENTION

For the problems mentioned above, an object of the invention is to provide a core for photographic light-sensitive material use wherein both disposability and adaptability for recycling are excellent, no influence of a step caused by an end of the light-sensitive material is given to the closest-to-core portion of the photographic light-sensitive material and dispersion in cut dimensions caused by dispersion in moisture content of a base material for the core is reduced, and to provide a manufacturing method therefor.

The object of the invention mentioned above can be attained by a core for photographic light-sensitive material use comprising a core made of paper, at least one buffer layer consisting totally of wood pulp whose density is not more than 0.1 g/cm$^3$ and a reinforcing sheet of paper with tensile strength of 0.3 kg/15 mm width or more that strengthens the buffer layer on one side or on both sides thereof and is united solidly with the buffer layer, and by a method for manufacturing the core for photographic light-sensitive material use wherein the buffer layer and a reinforcing layer are stuck together before spiral processing, the core roughly cut after the spiral processing is subjected to drying treatment so that its moisture content may reach 8% or less, and then the core is cut to the predetermined dimensions.

DESCRIPTION OF SYMBOLS

Figure 1:
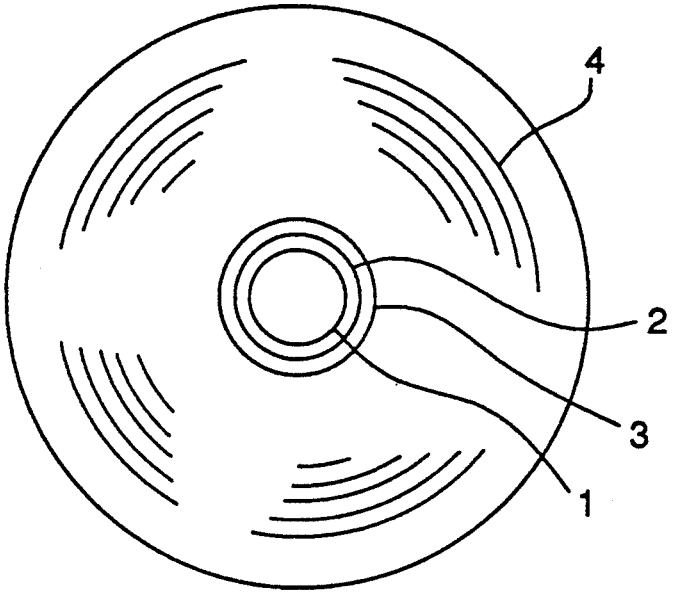
FIG. 1 is a side view showing how a photographic light-sensitive material is wound around a core.

1. Base material layer of a core
2. Buffer layer
3. Reinforcing layer
4. Photographic light-sensitive material
5. Closest-to-core end of photographic light-sensitive material
6. Reinforcing layer on internal side of core

DETAILED DESCRIPTION OF THE INVENTION

As paper to be used for a reinforcing layer, kraft paper, wood free paper, chipboard paper and recycled paper may be applicable if they have tensile strength of not less than 0.3 kg/15 mm and especially if they contain neither a polyethylene-laminated layer nor resin.

As a buffer layer, a material with density of not more than 0.1 g/cm$^3$ which is composed of wood pulp and has a buffer property may be used, and there may be used, for example, unwoven fabric, a core material for cardboard and Japanese paper among which the unwoven fabric is especially preferable.

Paper used for a material of a core includes kraft paper, chipboard paper and recycled paper.

With regard to this unwoven fabric, there are many methods for manufacturing it. A method for forming a web of the unwoven fabric roughly includes a wet method for forming an aggregate of fibers in water and a dry method for forming in the air.

With regard to an arrangement of fibers in a web formed through the above-mentioned methods, there are some types including one called a parallel type wherein each fiber is oriented in its longitudinal direction, another type wherein each fiber is oriented in the direction perpendicular to its length and one called a compound type wherein the above-mentioned two types are combined.

An object of each web-forming method mentioned above is to give the maximum strength in the direction of orientation of fibers. Any method mentioned above may be used for working of the invention.

A buffer layer mentioned above is wound around an entire surface of the core where a light-sensitive material is wound. The thickness of the buffer layer has only to be equal to or greater than the thickness of the light-sensitive material.

It is preferable that both buffer layer and reinforcing layer are glued together on one side or both sides thereof before the core is subjected to spiral processing. However, gluing together at the position before the portion for spiral processing may also be applicable, and the invention is not necessarily limited to this.

The directions in which a material for a core, a buffer material and a reinforcing material are wound are not limited in particular.

When gluing together, it is desirable that adhesives are coated or sprayed on the reinforcing layer to avoid causing the buffer layer to be moist and consequently weakened in strength remarkably and thereby causing problems in the gluing process.

When reinforcing on one side so that the reinforcing layer may be positioned on the internal side, a surface paper may be provided separately to be wound in the spiral processing.

Water-soluble adhesives and emulsion adhesives may be used for gluing each structural layer, and starch, casein and polysoda acrylate are applicable for the water-soluble adhesives, while vinyl acetate, SRB, NBR, acrylate and vinyl chloride are applicable as the emulsion adhesives, or a combination thereof may also be used.

A core which has been processed in terms of winding under the above-mentioned conditions is subjected to rough cutting to the dimension that gives the best yield in cutting processing and then dried to not more than 8% moisture content of the core through a drying means such as a hot air drying method, a method of drying under reduced pressure and an infrared drying method under the conditions of predetermined temperature, humidity, pressure and time. After that, it is cut to the required dimension.

It is also possible to improve dimensional accuracy for a core having no buffer layer in the methods mentioned above.

In the core for a photographic light-sensitive material prepared a mentioned above, occurrence of deformation and sensitivity abnormality on the closest-to-core portion of the light-sensitive material can be avoided because a step caused on the closest-to-core portion of the light-sensitive material by the thickness of a base material of the light-sensitive material is absorbed by the buffer layer.

Further, due to the employment of reinforcing paper, it has become possible to use a buffer material composed totally of pulp, which is ideal in terms of disposability and adaptability for recycling, but has been impossible to be used in the winding process as a core material due to its lower strength.

In addition to the above, the drying process conducted before cutting to the predetermined dimensions has greatly reduced dispersion of dimensions because the core material, when being cut, has been dried to the same level as in use.

Examples of the core for photographic light-sensitive material use of the invention will be explained as follows, referring to FIG. 1 through FIG. 8.

Figure 2:
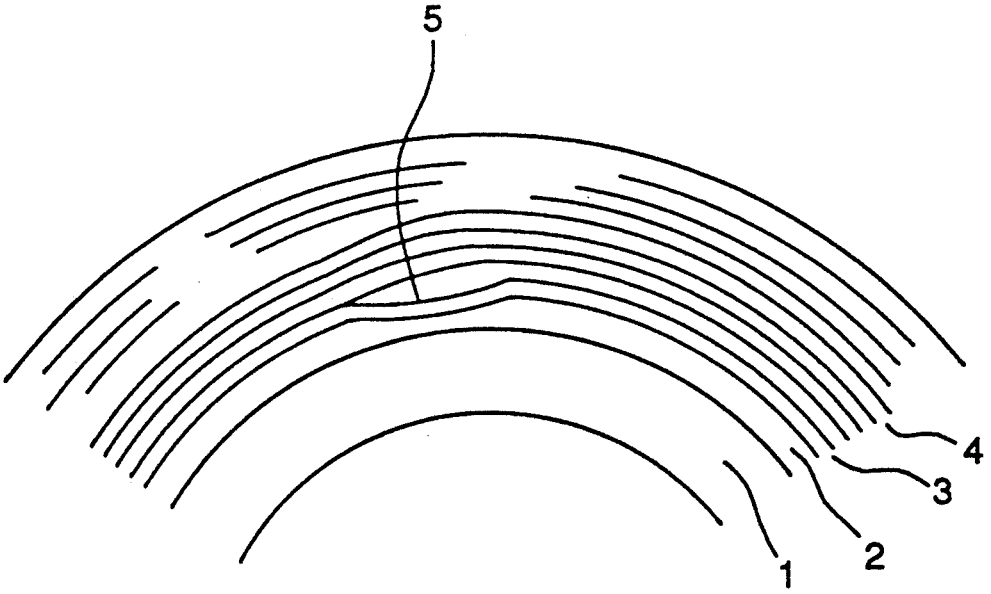
FIG. 2 is an enlarged view of a closest-to-core portion of a photographic light-sensitive material wound around a core.

FIG. 1 represents a side view showing how a photographic light-sensitive material is wound around the core of the invention. FIG. 2 is an enlarged view of an end portion of the photographic light-sensitive material shown in FIG. 1. FIG. 3 through FIG. 8 are sectional views showing the structure of the core.

In FIG. 1, photographic light-sensitive material 4 is wound around a core consisting of core base material layer 1, buffer layer 2 and reinforcing layer 3.

FIG. 2 shows that a step caused by the thickness of the closest-to-core end 5 of the photographic light-sensitive material 4 is absorbed in the buffer layer 2 and reinforcing layer 3 due to the buffer effect thereof.

Figure 3:
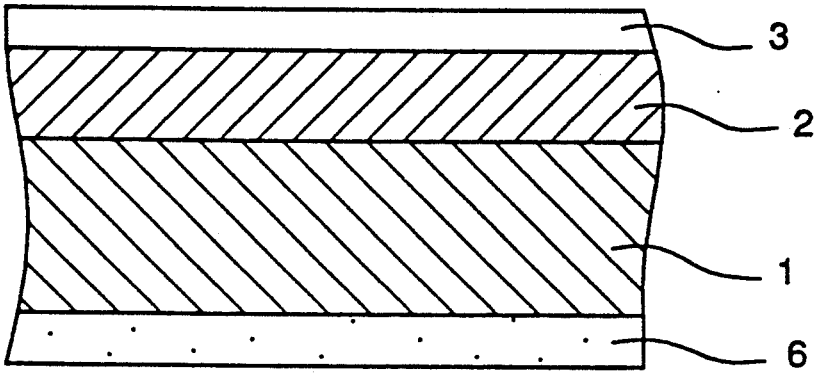
FIG. 3 is a sectional view showing an example of the structure of a core for photographic light-sensitive material.

FIG. 3 shows a core for photographic light-sensitive material use wherein buffer layer 2 is reinforced on its one side so that reinforcing layer 3 may form the surface of the core. Reinforcing 3, buffer layer 2, core base material layer 1 and internal side-reinforcing layer 6 are glued and laminated.

Figure 4:
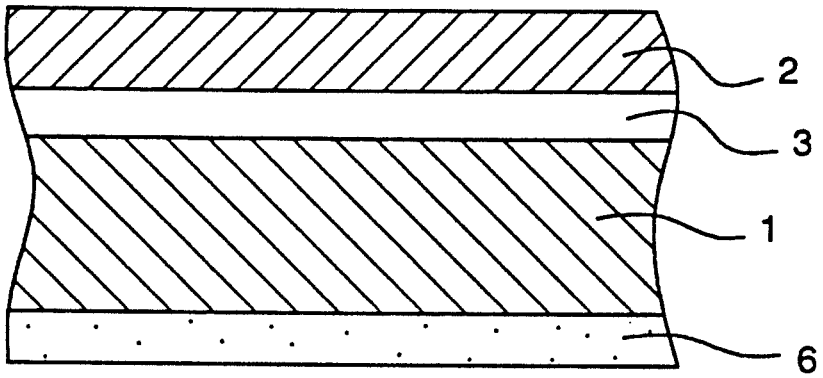
FIG. 4 is a sectional view showing an example of the structure of a core for photographic light-sensitive material.

FIG. 4 shows a core for photographic light-sensitive material use wherein buffer layer 2 is reinforced on its one side so that the buffer layer 2 may form the surface of the core. Buffer layer 2, reinforcing layer 3, core base material layer 1 and internal side-reinforcing layer 6 are glued and laminated.

Figure 5:
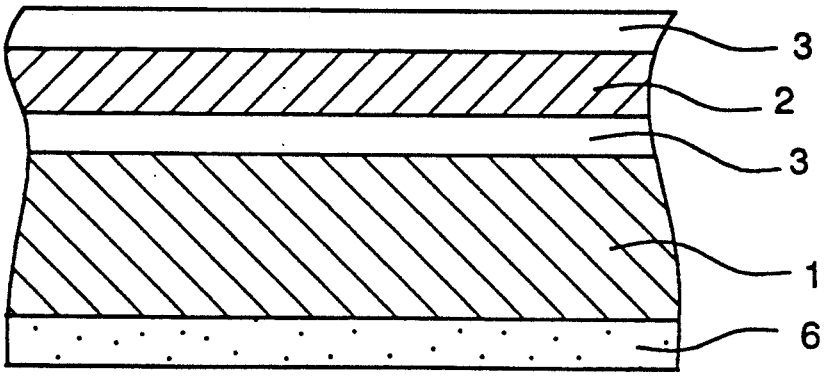
FIG. 5 is a sectional view showing an example of the structure of a core for photographic light-sensitive material.

FIG. 5 shows a core for photographic light-sensitive material use wherein buffer layer 2 is reinforced on both of its sides. Reinforcing layer 3, buffer layer 2, reinforcing layer 3, core base material layer 1 and internal side-reinforcing layer 6 are glued and laminated.

Figure 6:
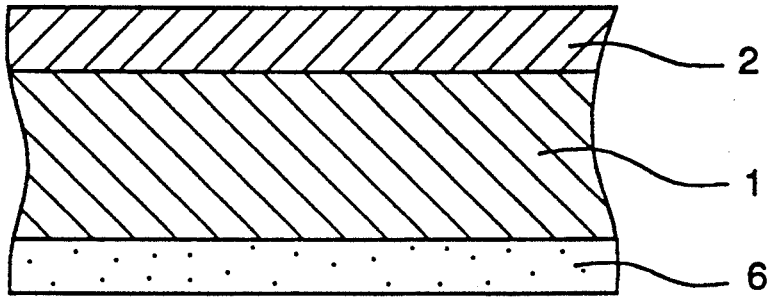
FIG. 6 is a sectional view showing an example of the structure of a core for photographic light-sensitive material.

FIG. 6 shows a core for photographic light-sensitive material use wherein buffer layer 2 is reinforced on its one side so that buffer layer 2 may form the surface of the core, and reinforcing layer 3 used is the same as core base material layer 1. Buffer layer 2, core base material layer 1 and internal side-reinforcing layer 6 are glued and laminated.

Figure 7:
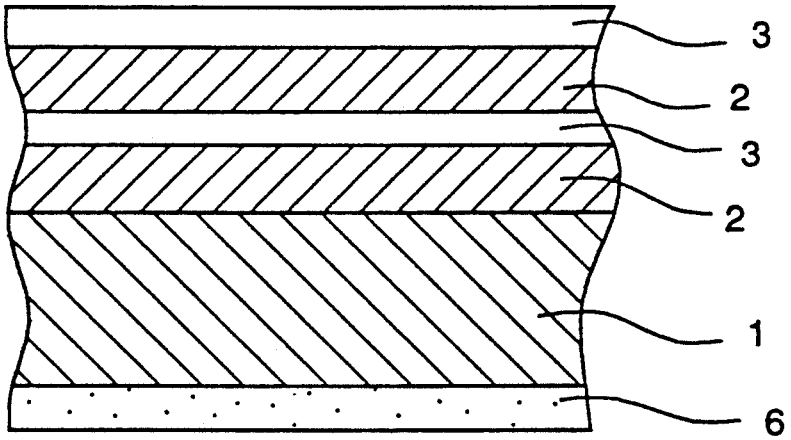
FIG. 7 is a sectional view showing an example of the structure of a core for photographic light-sensitive material.

FIG. 7 shows a core for photographic light-sensitive material use wherein buffer layer 2 is reinforced on its one side so that buffer layer 2 may form the surface of the core, and two buffer layers 2 and two reinforcing layers 3 are provided, and core base material layer 1 and internal side-reinforcing layer 6 are glued and laminated.

Figure 8:
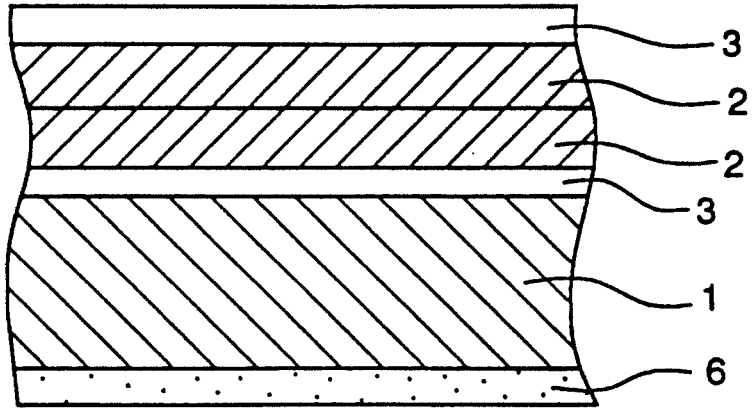
FIG. 8 is a sectional view showing an example of the structure of a core for photographic light-sensitive material.

FIG. 8 shows a core for photographic light-sensitive material use wherein buffer layer 2 is reinforced on its both sides so that reinforcing layer 3 may reinforce the buffer layer 2 whose fiber direction is different from that of the reinforcing layer 3, and core base material layer 1 and internal side-reinforcing layer 6 are glued and laminated.

EXAMPLE

Results of evaluation by means of comparison of design characteristics between Samples A and B of the invention and conventional Samples C and D will be explained as follows.

SAMPLE A OF THE INVENTION

With regard to the structure, this sample is the same as the above-mentioned FIG. 3. As a base material of the core, a sheet of paper that is generally used as a material of a core for photographic light-sensitive material and has density of 0.65 g $cm^3$ was used, and a 2.5 mm thick dry unwoven fabric having density of 0.1 g/$cm^3$ and being composed totally of wood pulp was used as a buffer layer which was reinforced on its one side with a reinforcing lay of wood free paper with density of 0.3 g/$cm^3$.

For both the buffer layer and the reinforcing layer, adhesives of a vinyl acetate type were coated on the reinforcing layer before winding the core spirally and they were glued together with tensile force of 0.3 kg/15 mm or less. After storage for 24 hours, they were wound spirally together with the above-mentioned core base material and were cut roughly to 1700 mm lengths, The core roughly cut was left for 2 hours and then was laid down on a pallet and dried at 50° C. for 12 hours so that its moisture content may be adjusted to 5%–4%. Then, it was cut to the width of 127 mm.

As a photographic light-sensitive material, a color photographic paper measuring 0.25 mm in thickness, 127 mm in width and 175 m in length was wound around the core under the conditions of tensile force for winding and winding speed both equal to those used in normal manufacturing. After being wound, an adhesive label was applied on the end of wound paper for preventing the paper from loosening and a light-shielding cover was provided thereon in an ordinary way.

SAMPLE B OF THE INVENTION

As a buffer layer, a 1 mm thick dry unwoven fabric composed totally of wood pulp and having a density of 0.04 g/$cm^3$ was used.

Conditions other than the above were the same as in Sample A of the invention.

CONVENTIONAL SAMPLE C

As a core base material, a paper with density of 0.65 g/$cm^3$ used generally as a core material for photogaphic light-sensitive material use was used. As a buffer layer, a 1 mm thick foamed polystyrene sheet with foaming rate of 15 times was used. Both of them were wound spirally and cut roughly to the length of 1700 mm.

Immediately after being left for 2 hours, the roughly cut core was cut to 127 mm and then packaged in a cardboard box under the same conditions as in conventional packaging, and dried at 50° C. for 24 hours.

Conditions other than the foregoing are the same as those in Sample A of the invention.

CONVENTIONAL SAMPLE D

This is a core which has no buffer layer and is provided on its surface with wood free paper wound thereon, and other conditions are the same as those in Conventional Sample C.

Samples were evaluated by the following evaluation method, and the results of the evaluation are shown in Table 1.

EVALUATION METHOD

Degree of Deformation (Press Mark)

Each sample to be evaluated prepared in the manner explained in the examples was stored for 7 days under the conditions of 50° C. and 20% RH or less as accelerated conditions which correspond to long term preservation, and then stored for 2 days at 5° C. in a refrigerator.

Evaluation was conducted through two methods including a visual check in the light method wherein a range of deformation (press mark) is measured by observing visually the difference of gloss on the surface of a photographic paper starting from the closest-to-core portion to the farthest-from-core portion and a practical judgment evaluation method wherein about 20 m from the closest-to-core portion of a photographic paper is sampled in a dark room and subjected to printing employing a standard negative used in judgment for product shipment in order to evaluate how the degree of deformation affects adversely an actual photograph.

Sensitive Abnormality

Each sample to be evaluated prepared in the manner explained in the examples was stored for 7 days under the conditions of 50° C. and 20% RH or less as accelerated conditions which correspond to long term preservation, and then stored for 2 days at 5° C. in a refrigerator.

Evaluation was conducted through sensitometry wherein sampling was made for every 30 cm from the closed-to-core portion of a photographic paper, and test pieces thus picked up were exposed and processed for obtaining photosensitive characteristics of photographic light-sensitive materials in a sensitometer wherein intensity of light can be changed so that various exposures of different intensities may be conducted.

Disposability

As criteria of judgment for disposability, whether or not a core is made of a single material and whether there is possibility of decomposition caused by rain, sunlight and microbes when the core is left in natural environment, were taken into consideration.

Adaptability for Recycling

As criteria of judgment for adaptability for recycling, three points including whether or not a core is made of a single material, whether it is possible or not to separate different materials by man power when the core is made of different materials and whether it is possible to recycle the core as paper or not were taken into consideration.

Cost

Cost of each sample was evaluated through comparison with Conventional Sample C as a standard (1.0).

Dispersion

Each core prepared in a manner explained in the examples was evaluated in terms of dispersion through a method wherein 100 pieces of cores were sampled at random from each group before a photographic paper was wound around each of the cores, and each core was measured by a vernier three times in terms of cut dimension to obtain the dispersion from the distribution of the measured dimensions.

Results of evaluation through comparison in Table 1

| Items | Sample A of the invention | Sample B of the invention | Conventional sample C | Conventional sample D |
|---|---|---|---|---|
| Degree of deformation | a | a | a–b | d |
| Sensitivity abnormality | a | a | a | b |
| Disposability | a | a | d | a |
| Adaptability for recycling | a | a | d | a |
| Cost | c | b | a | a |
| Dispersion | a | a | c–d | c–d |

(Dimension)
a: Very excellent
b: Excellent
c: Within limit of practical use
d: Not usable (needs improvement)

As is apparent from Table 1, Samples A and B of the invention are excellent totally for all evaluation items compared with Conventional Samples C and D

EFFECT OF THE INVENTION

Due to the present invention, it is possible to provide a core for photographic light-sensitive material use having excellent disposability and adaptability for recycling and a manufacturing method therefor wherein a closest-to-core portion of a photographic light-sensitive material is not affected by a step caused by the end of the light-sensitive material and dispersion of cut dimension of moisture content in a base material of the core is reduced.

What is claimed is:

1. A core for photographic light-sensitive material comprising:
   - a center core consisting essentially of paper;
   - a buffer layer consisting essentially of wood pulp having a density of not more than 0.1 g/cm$^3$; and
   - a reinforcing layer provided on the buffer layer and consisting essentially of paper having a tensile strength of not less than 0.3 kg/15 mm width.

2. The core of claim 1, wherein the same material is used to form the center core, the buffer layer and the reinforcing layer.

3. The core of claim 1, wherein the core can be recycled to make paper.

4. The core of claim 1, wherein the materials that are used to form the center core, the buffer layer and the reinforcing layer can be decomposed in the natural environment.

5. A core for photographic light-sensitive material that is made of material from a wooden source, the core consisting essentially of:
   - a center core consisting essentially of paper;
   - a buffer layer consisting essentially of wood pulp having a density of not more than 0.1 g/cm$^3$; and
   - a reinforcing layer having a tensile strength of 0.3 kg/15 mm width, wherein said reinforcing layer consists essentially of paper and a glue.

* * * * *